US007269981B2

(12) United States Patent
Kwon

(10) Patent No.: US 7,269,981 B2
(45) Date of Patent: Sep. 18, 2007

(54) HOOK ASSEMBLY FOR DOOR IN WASHING MACHINE

(75) Inventor: Ik Kun Kwon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 595 days.

(21) Appl. No.: 10/722,390

(22) Filed: Nov. 28, 2003

(65) Prior Publication Data

US 2004/0177656 A1 Sep. 16, 2004

(30) Foreign Application Priority Data

Nov. 28, 2002 (KR) ..... 10-2002-0075056

(51) Int. Cl.

| | |
|---|---|
| ***B08B 3/12*** | (2006.01) |
| ***D06F 33/00*** | (2006.01) |
| ***D06F 39/00*** | (2006.01) |
| ***B65D 25/24*** | (2006.01) |
| ***E05C 7/00*** | (2006.01) |

(52) U.S. Cl. ..... 68/3 R; 68/12.01; 68/12.26; 68/196

(58) Field of Classification Search ..... 68/3 R, 68/12.01, 12.26, 196; 292/24, 99, 76, 163, 292/101, 107, 100, 108, 200, 226; 70/101, 70/181; 220/478, 521, 522, 526, 315
See application file for complete search history.

(56) References Cited

U.S. PATENT DOCUMENTS

| | | | | |
|---|---|---|---|---|
| 3,603,631 | A * | 9/1971 | White | 292/220 |
| 5,292,159 | A * | 3/1994 | Sandhu et al. | 292/173 |
| 5,630,630 | A * | 5/1997 | Price et al. | 292/128 |
| 6,036,241 | A * | 3/2000 | Ostdiek et al. | 292/229 |

* cited by examiner

*Primary Examiner*—Michael Kornakov
*Assistant Examiner*—Rita R Patel
(74) *Attorney, Agent, or Firm*—Ked & Associates, LLP

(57) ABSTRACT

A hook assembly for a door in a washing machine is provided having a decreased number of elements as well as more convenient assembly with respect to conventional apparatus. The hook assembly includes a pair of supporters directly extending from an insider of a doorframe of a washing machine, a shaft penetrating the supporters, a hook rotatably coupled to the shaft, wherein a head of the shaft penetrates the doorframe to be externally exposed, and an elastic member provided in the doorframe to give an elastic force to the hook.

21 Claims, 8 Drawing Sheets

HOOK ASSEMBLY FOR DOOR IN WASHING MACHINE

This application claims the benefit of Korean Application(s) No. 10-2002-0075056 filed on Nov. 28, 2002, which is/are hereby incorporated by reference.

BACKGROUND OF THE INVENTION

1. Field of the Invention

The present invention relates to a washing machine, and more particularly, to a hook assembly for a door in a washing machine having a simple structure constructed with less parts and easy assembly.

2. Discussion of the Related Art

Generally, a washing machine is an apparatus for removing contaminating particles attached to the laundry, e.g., clothes, linen, etc., using reaction between water and detergent. Such a washing machine is categorized into an agitator type, a pulsator type and a drum type.

In the drum type washing machine, a drum holding the laundry, water, and detergent inside is rotated to lift the laundry up by protrusions to perform washing using the shock energy of the laundry falling down and a frictional force thereof. Such a drum type washing machine avoids causing damage to the laundry and prevents the laundry from being entangled, thereby prevailing in use gradually.

Meanwhile, FIG. 1 is a perspective view of a drum type washing machine according to a related art.

Referring to FIG. 1, a cabinet 10 forms an overall exterior of a drum type washing machine, and a laundry entrance 12 is formed at a front side of the cabinet 10. A drum 40 is rotatably installed in the cabinet 10. A door assembly is provided to the front side of the cabinet 10 to open/close the laundry entrance 12. And, the door assembly consists of a hinge assembly 15, a door body 20, a hook assembly 30, and a lock assembly (not shown in the drawing).

FIG. 2 to FIG. 4 are diagrams of a door assembly in FIG. 1. The door assembly is explained in detail by referring to FIG. 2 to FIG. 4 as follows.

The hinge assembly 15, as shown in FIG. 2 and FIG. 3, is formed at one portion of the cabinet 10 in the vicinity of the laundry entrance 12, and rotatably couples a doorframe 21 to the cabinet 10.

The door body 20 consists of a door frame 21 constructed with inner and outer frames 22 and 23 coupled to each other to have an opening at a central part, a door glass 24 provided to the opening to have its circumference fixed between the inner frame and outer frames 22 and 23 of the door frame 21, and a grip 25 provided to the door frame 21. The doorframe 21 is coupled to the hinge assembly 15. And, the grip 25 is formed to protrude from a certain spot of the door frame 21, e.g., an inner circumference of the outer frame 23, as shown in FIG. 1 and FIG. 2, to be grabbed by a user externally.

The hook assembly 30 is formed at one side of the doorframe 21, e.g., a certain spot of the inner frame 22, as shown in FIG. 2 and FIG. 3. The hook assembly 30 includes a hook 31, a spring (not shown in the drawing), and a fixing member 32.

The hook 31 has a head protruding from its one side convexly. The hook 31 is attached to the fixing member 32. The head lies outside the fixing member 32, as shown in FIG. 4, and an end of the hook 31 opposite to the bead is disposed inside or at a rear side of the fixing member 32. For this, a hole 33 is provided to the fixing member 32 to be penetrated by the hook 31. Meanwhile, the fixing member 32 and the inner frame 22 are separately prepared. The spring is provided inside or the rear side of the fixing member 32. One end of he spring is connected to the fixing member 32 and the other end is connected to the hook 31. Thus, the spring gives an elastic restoring force to the hook 31.

The above-constructed hook assembly 30 having been completely assembled is loaded in the doorframe 21. Specifically, the fixing member 32 is installed at an inside of the inner frame 22 by screws or the like. After the fixing member 32 has been installed, the head of the hook 31 penetrates into the inner frame 22 to be externally exposed. For this, a hook hole **22*h*, as shown in FIG. 4, is formed at a certain spot of the inner frame 22 to be penetrated by the head of the hook 31**.

Meanwhile, the lock assembly (not shown in the drawing) is provided to another spot of the cabinet 10 to keep the doorframe 21 closed by holding the head of the hook 31. The lock assembly locks the hook 31 so that the doorframe 21 is not externally opened or releases the hook 31 to let the doorframe 21 be externally opened according to an electric signal transferred from a control unit (not shown in the drawing). Thus, when power is applied to the lock assembly of a general washing machine or dryer, the assembly locks the hook 31 so that it is unable to forcibly open the doorframe 21.

However, in the related art hook assembly 30 of the door assembly, the fixing member 32 has to be fixed to the inner frame 22 by screws or the like after the hook 31 and spring have been assembled to the separately prepared fixing member 32. Hence, the number of the respective parts increases as well as assembling is complicated to reduce productivity.

SUMMARY OF THE INVENTION

Accordingly, the present invention is directed to a hook assembly for a door in a washing machine that substantially obviates one or more of the problems due to limitations and disadvantages of the related art.

An object of the present invention, which has been devised to solve the foregoing problem, lies in providing a hook assembly for a door in a washing machine by which the number of elements decreases as well as assembling becomes more convenient.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a hook assembly of a door in a washing machine including a pair of supporters directly extending from an inside of a doorframe of the washing machine, a shaft penetrating the supporters, a hook rotatably coupled to the shaft wherein a head of the shaft penetrates the doorframe to be externally exposed, and an elastic member provided in the doorframe to give an elastic force to the hook.

The doorframe may include separable inner and outer frames. In this case, the supporters extend from either the inner frame or the outer frame.

The hook assembly further includes stoppers extending from the inside of the doorframe to prevent the shaft from being separated from the supporters. In this case, the supporters lie between the stoppers. Preferably, a distance between the stoppers is greater than a length of the shaft.

The doorframe includes separable inner and outer frames, and the stoppers extend from the inner and outer frames, respectively. Moreover, each of the stoppers includes a reinforcement rib provided to one side opposite to the other side supporting a corresponding end of the shaft.

And, the hook assembly further includes a grip having one end rotatably connected to the shaft and the other end externally exposed wherein the one end elastically turns the hook if the other end moves. In this case, both ends of the elastic member are connected to the hook and the grip, respectively so that the hook is moved together with the grip.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
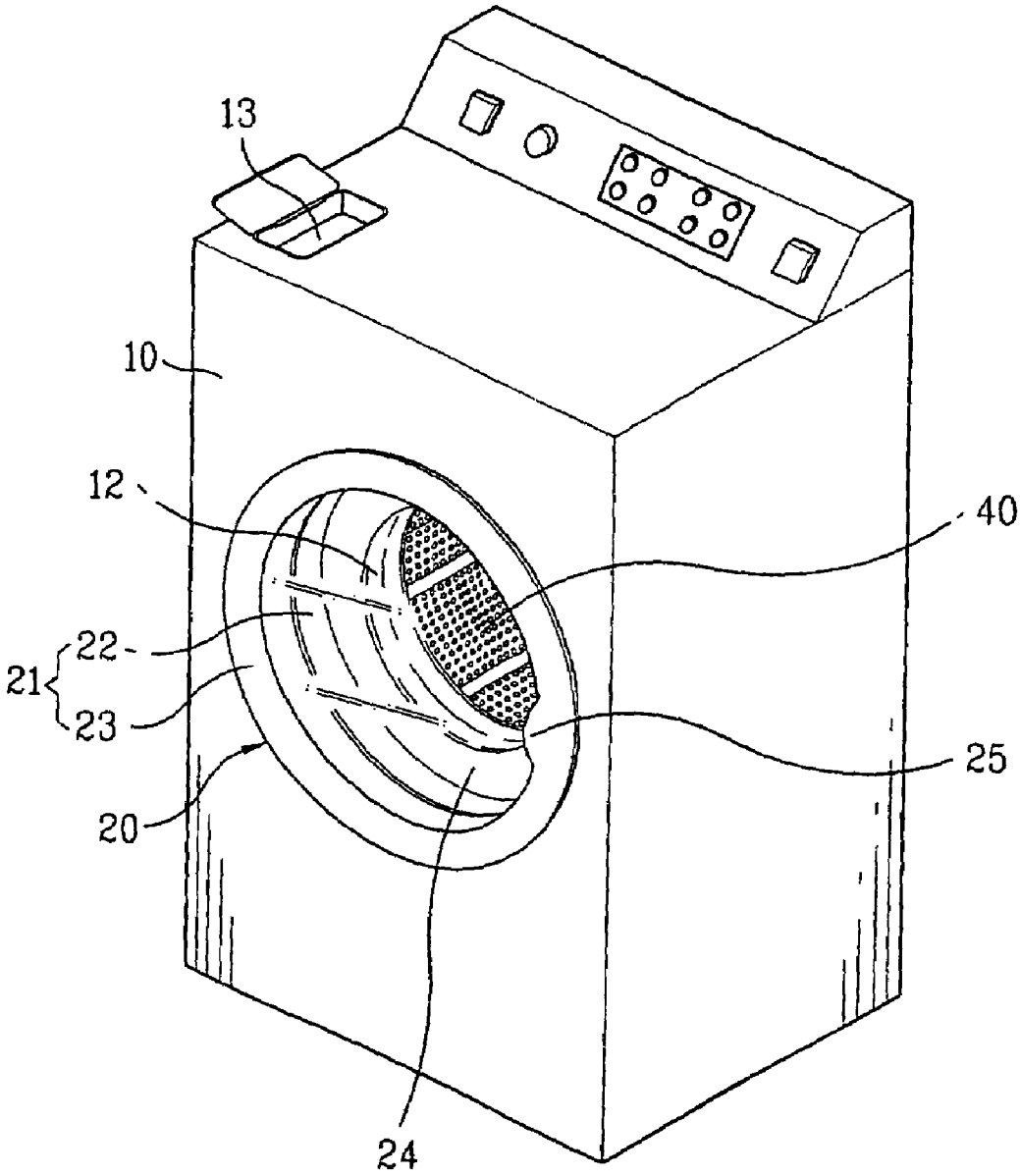
FIG. 1 Prior Art
FIG. 1 is a perspective view of a washing machine according to a related art.
Figure 2:
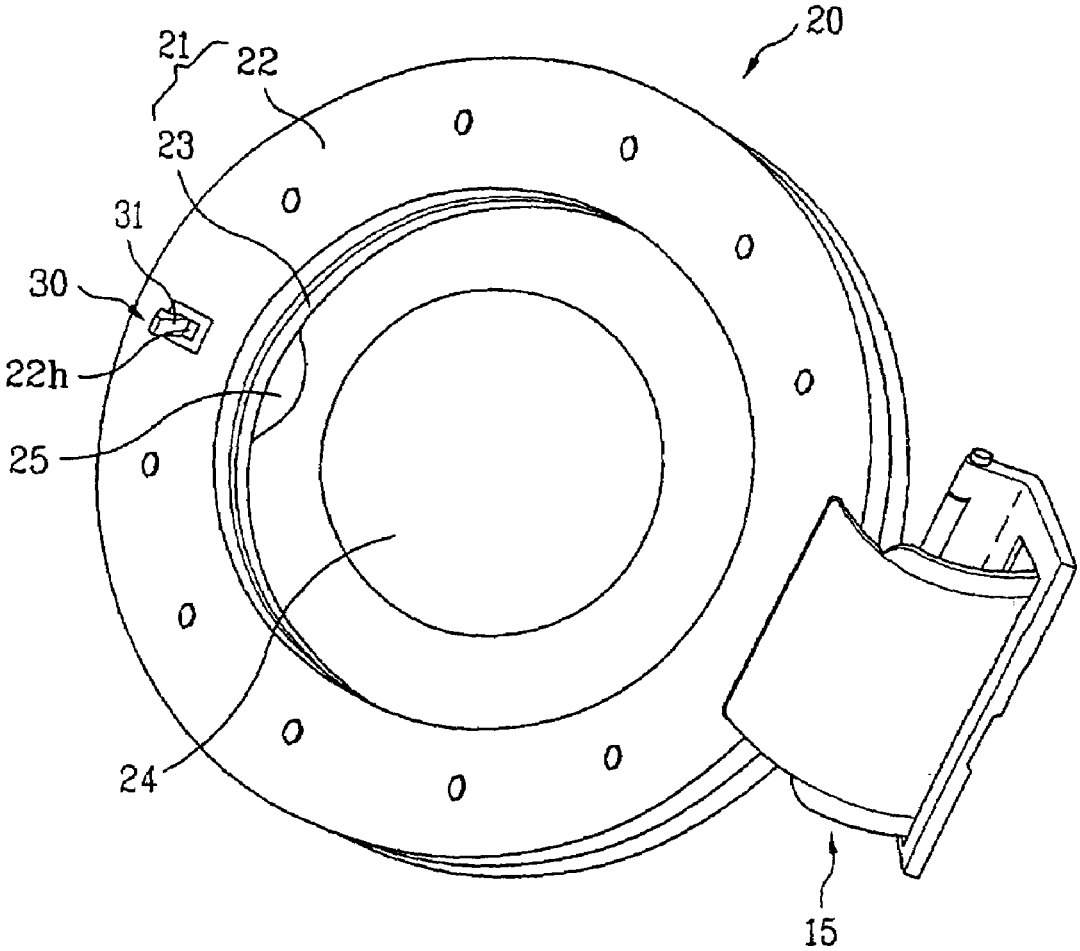
FIG. 2 Prior Art
FIG. 2 is a perspective view of a door assembly of a washing machine in FIG. 1.
Figure 3:
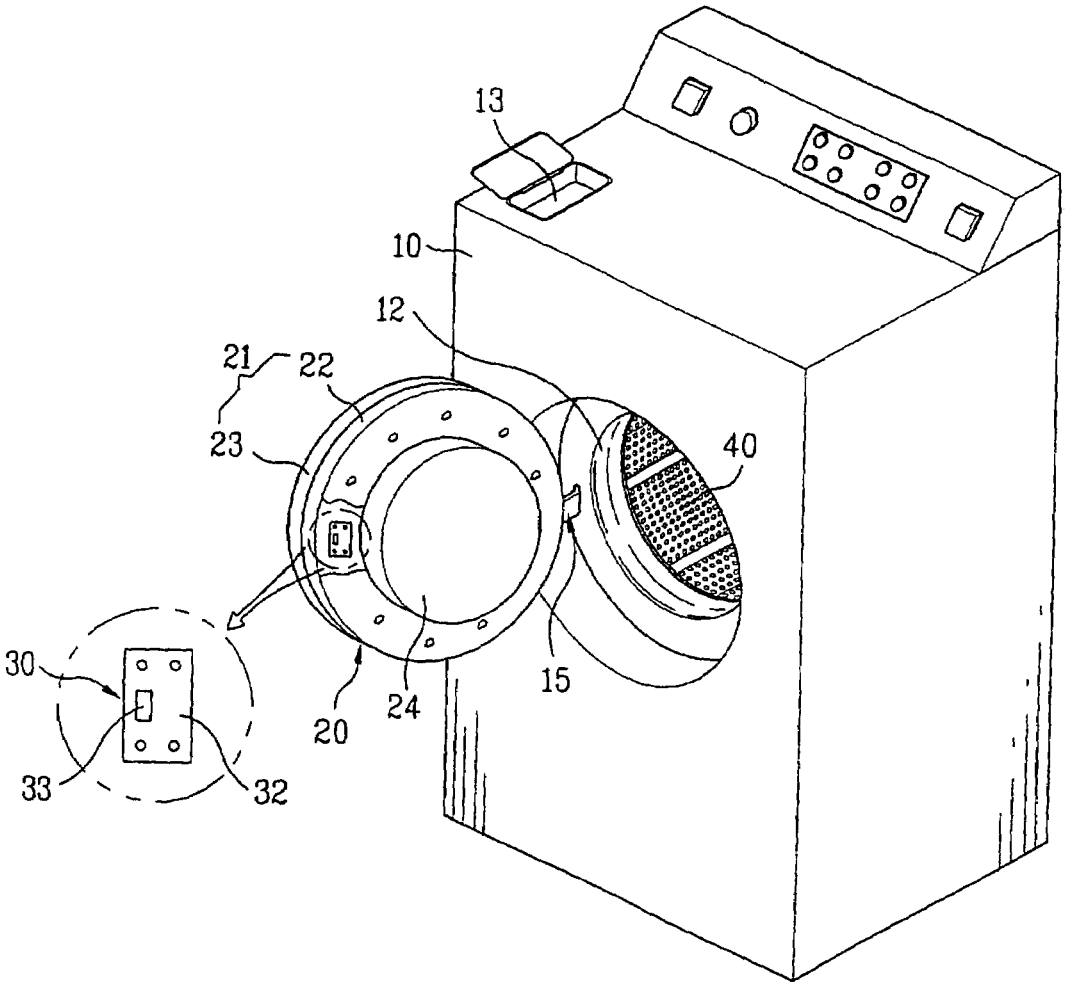
FIG. 3 Prior Art
FIG. 3 is a perspective view of a door frame of a washing machine in FIG. 1, in which a door frame is shown.
Figure 4:
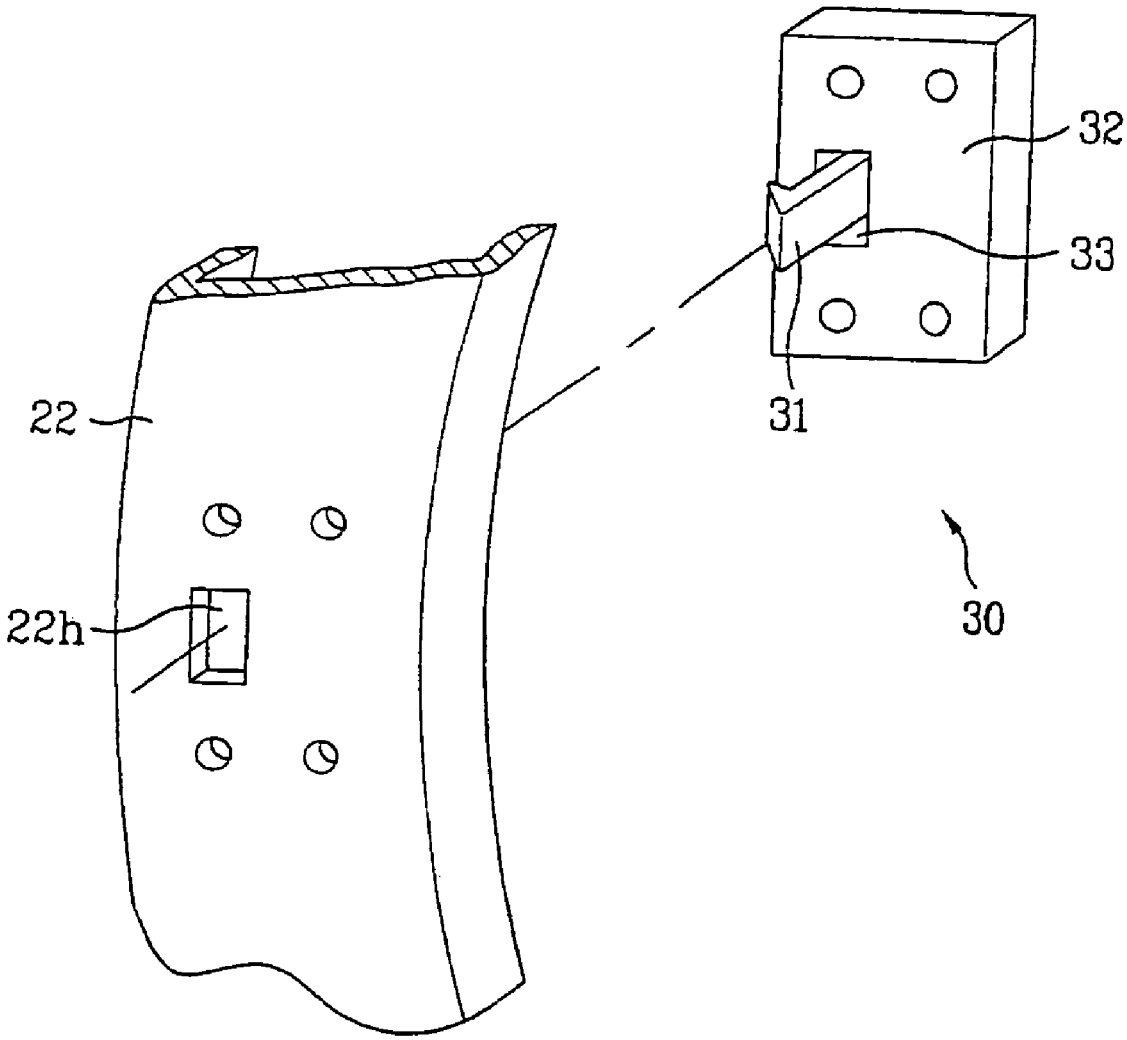
FIG. 4 Prior Art
FIG. 4 is a perspective view of a hook assembly and a door frame of a washing machine in FIG. 1.
Figure 5:
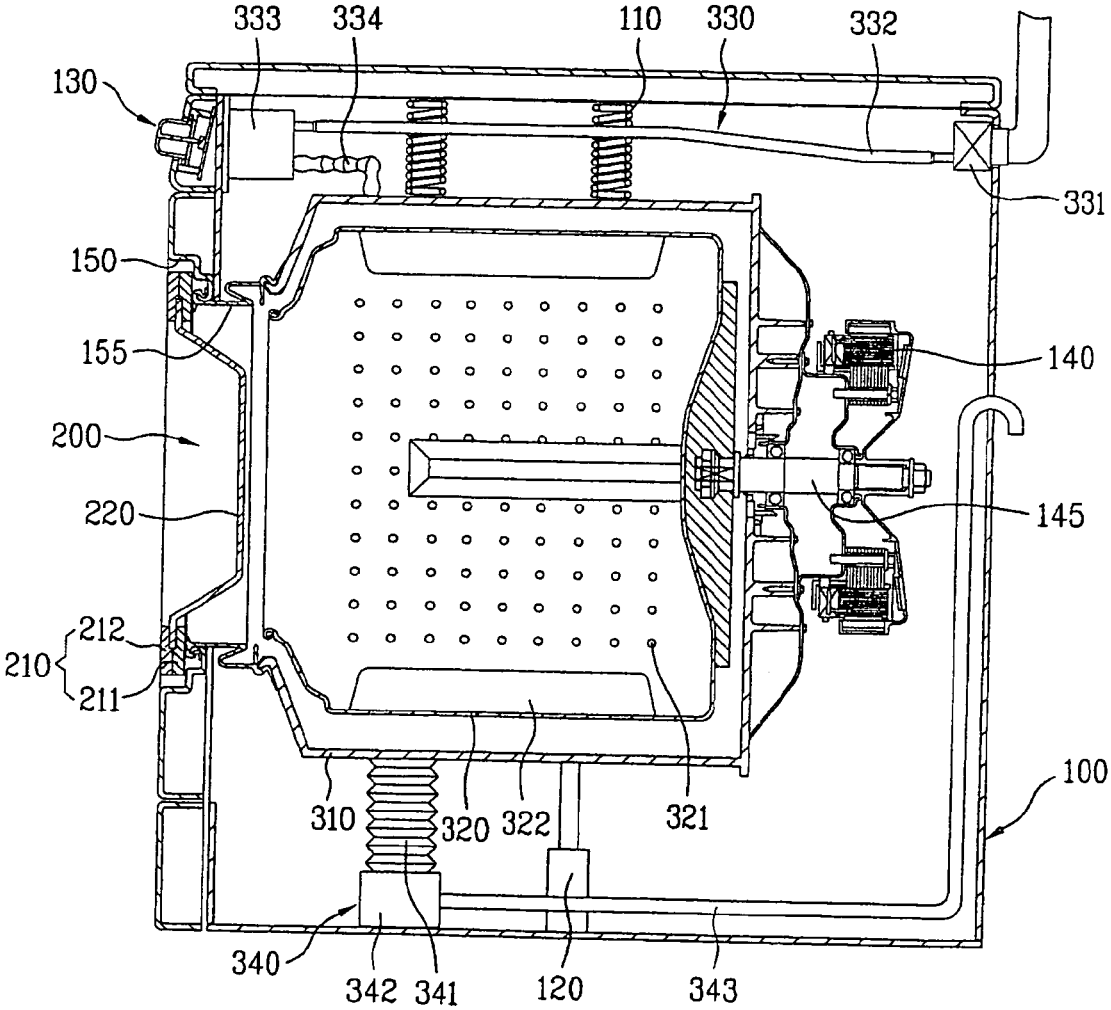
FIG. 5 is a cross-sectional view of a washing machine according to the present invention.

FIG. 5 is a cross-sectional view of a washing machine according to the present invention.

Referring to FIG. 5, a tub 310 is suspended in a cabinet 100. For this, a top of the tub 310 is connected to a spring 110 fixed to the cabinet 100 and a bottom of the tub 310 is connected to a damper 120 hinge-coupled to a bottom of the cabinet 100. The provided spring and damper 110 and 120 play a role in suspending the tub 310 in the cabinet 100 elastically as well as attenuating vibration appearing on the tub 310 while a washing machine operates.

A drum 320 is rotatably provided in the tub 310. For this, a motor 140 is provided in the cabinet 100, and more specifically, in rear of the tub 310 and the drum 320 is connected to the motor 140 through a shaft 145.

A multitude of perforated holes 321 perforate into a circumference of the rum 320 and a plurality of tumbling ribs 322 are provided on an inner circumference of the drum 320. Hence, water supplied to the tub 310 enables to communicate between the drum 302 and the tub 310 via the perforated holes 321. A laundry having put in the drum 320 is lifted up by the tumbling ribs 322 and then falls down while the drum 320 rotates. Hence, frictional and shock energy can be sufficiently provided for washing when the laundry falls down.

An entrance 150 is provided to a front side of the cabinet 100 so that the laundry is put in or pulled out of the drum 320, and a door assembly 200, which will be explained in detail by referring to FIG. 6A to FIG. 7 later, is provided to open/close the entrance 150. A gasket 155 is provided between the entrance 150 and an opening of the tub 310 to prevent the water held in the drum and tub 310 and 320 from leaking.

A water supply equipment 330 and a drain equipment 340 are provided in the cabinet 100. The water supply equipment 330 includes an inlet valve 331, an inlet hose 332, a detergent box 333, and an inlet bellows 334. The inlet valve 331 closes or opens a passage of water supplied from outside, and the inlet hose 332 connects the inlet valve 331 to the detergent box 333. And, the inlet bellows 334 connects the detergent box 333 to the tub 310. Hence, when the inlet valve 331 is turned on, the water is supplied to the tub 310 via the inlet hose 332, detergent box 333, and inlet bellows 334. In this case, the detergent stored in the detergent box 333 is supplied to the water if necessary.

The drain equipment 340 includes a drain bellows 341, a drain pump 342, and a drain hose 343. The drain bellows 341 connects the tub 310 to the drain pump 342. One end of the drain hose 343 is connected to the drain pump 342, and the other end of the drain hose 343 communicates with an external atmosphere. Hence, once the drain pump 342 operates, the water in the tub 310 is discharged via the drain bellows 341, drain pump 342, and drain hose 343.

And, a control panel 130 is provided on one side, e.g., a top, of the cabinet 100 so that a user operates the control panel 130 to control the washing machine.

Figure 6A:
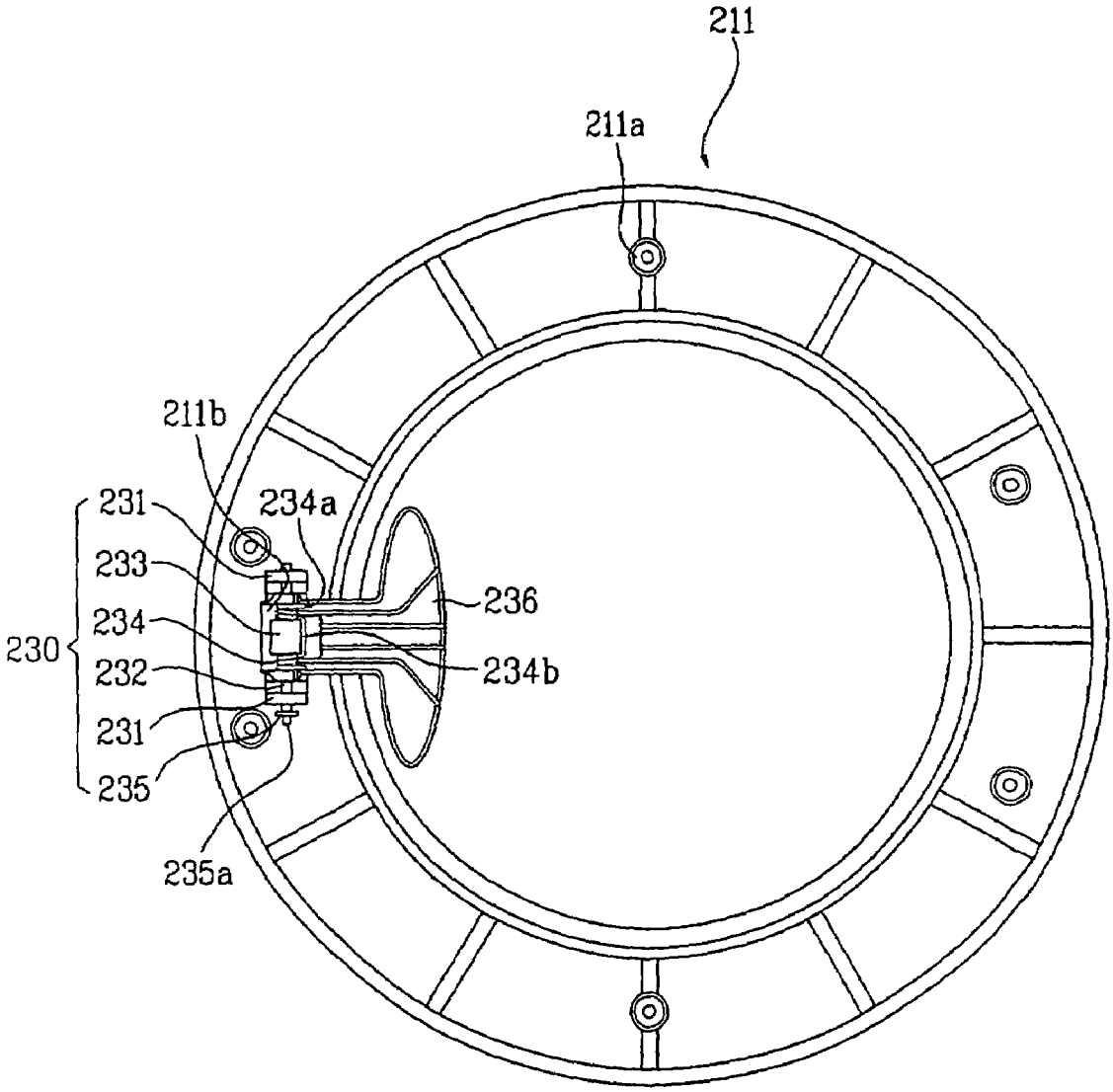
FIG. 6A is a layout of a door assembly according to the present invention, in which a hook assembly loaded in an inner frame is shown.
Figure 6B:
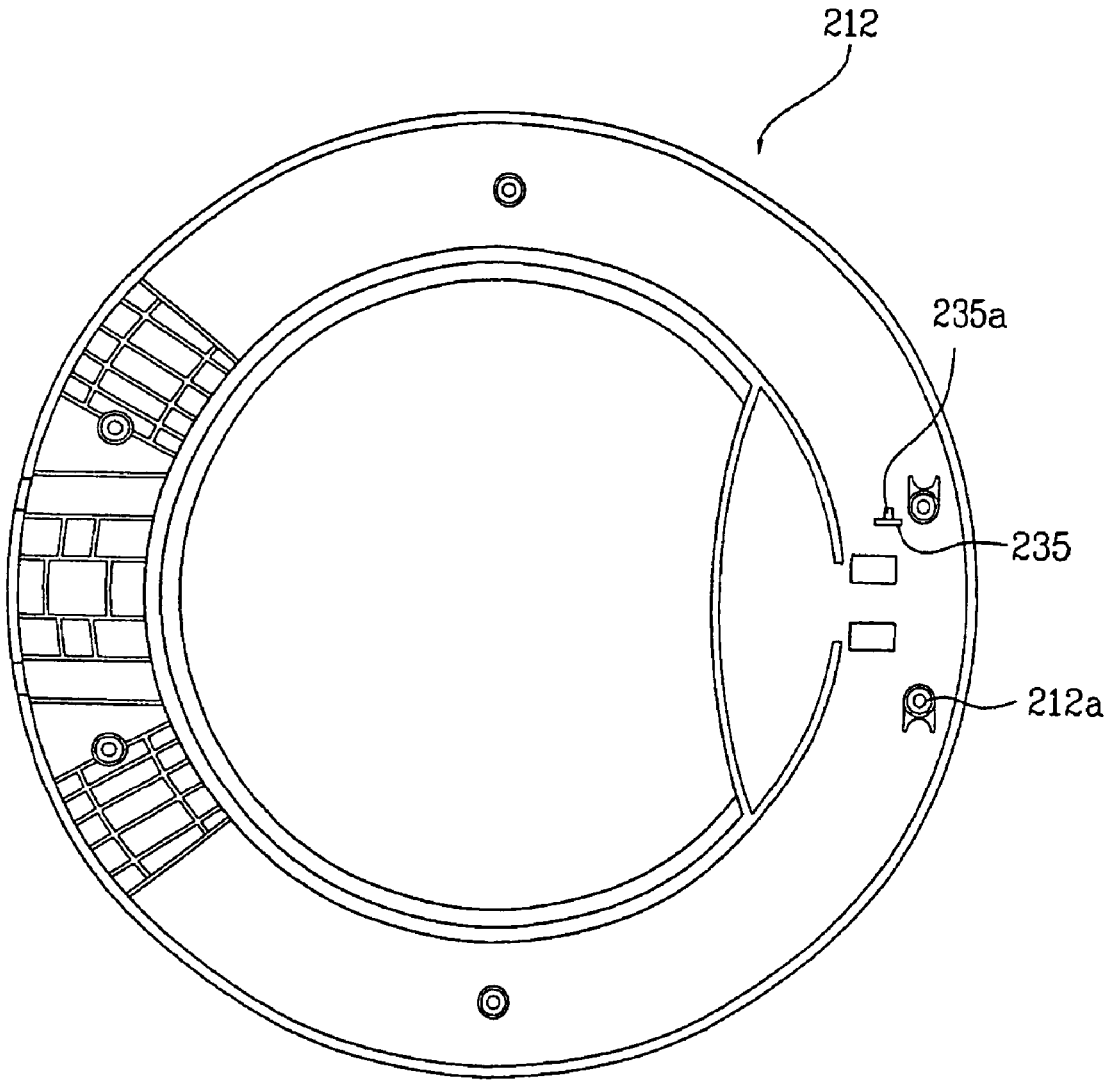
FIG. 6B is a layout of an outer frame of a door assembly according to the present invention.
Figure 7:
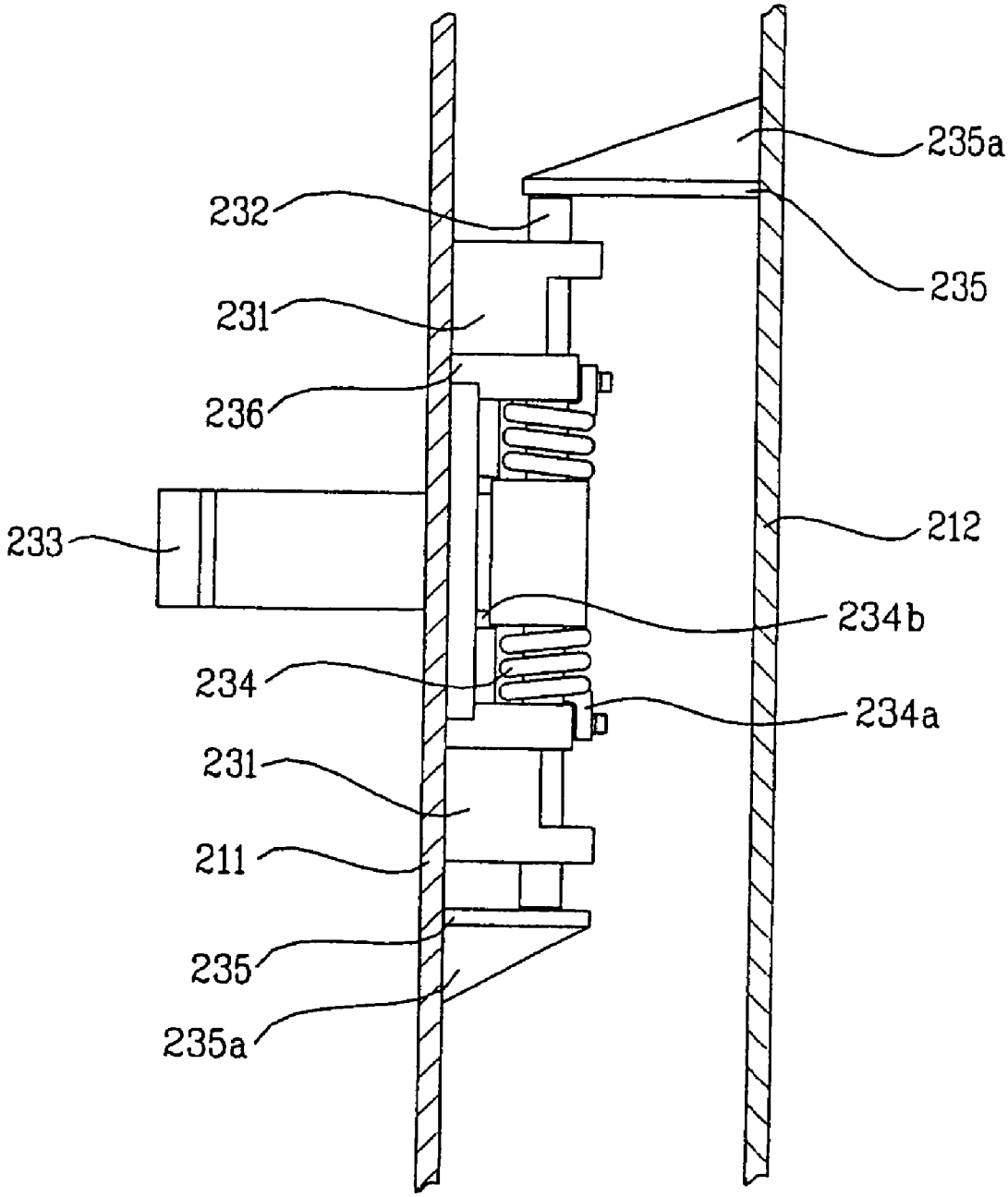
FIG. 7 is a cross-sectional view of a hook assembly loaded in a doorframe according to the present invention.

Meanwhile, a door assembly according to the present invention is shown in FIG. 6A to FIG. 7.

Referring to FIG. 6A and FIG. 6B, a doorframe 210 includes an inner frame 211 and an outer frame 212. The inner frame 211 and the outer frame 212 are coupled to each other by coupling members such as bolts, screws, etc. In this case, the coupling members are inserted in bosses 211*a* and 212*a* to be fixed thereto, respectively. Meanwhile, each of the inner and outer frames 211 and 212 has a ring type opening at its central part. A transparent door glass (not shown in the drawing) is provided to the opening. And, the door glass is fitted between the inner and outer frames 211 and 212 to be fixed thereto.

A cavity is provided in the doorframe 210, and various parts constructing a hook assembly 230 are provided to the cavity. The hook assembly 230 according to the present invention is directly formed in the doorframe 210 unlike the related art hook assembly that is separately prepared to be loaded in the related art doorframe. The hook assembly 230 includes supporters 231, a shaft 232, a hook 233, and an elastic member 234, which is explained in detail by referring to the attached drawings as follows.

First of all, the supporter 231, as shown in FIG. 6A and FIG. 7, directly extends from an inside of the doorframe 210, e.g., the inner frame 211. Instead, the supporter 231 can be formed at the outer frame 212 as well. Meanwhile, a pair of the supporters 231 extend from the inner frame to leave a predetermined interval from each other for example. And, a shaft hole (not shown in the drawing) is formed at an upper part of each of the supporters 231. Meanwhile, a hole 211*b* is formed at a portion of the inner frame 211 between the supporters 231 to be penetrated by the hook 233.

The shaft 232 is fitted to the supporters 231 to be fixed thereto. Both ends of the shaft 232 pass through the shaft holes to be partially exposed out of the supporters 231, respectively.

The hook 232 includes a head having one protruding side, and an end of the hook 233 opposite to the head is rotatably coupled to the shaft 232. In this case, the head passes through the hole 211*b* of the inner frame 211 to be externally exposed. Meanwhile, when the door assembly 200 closes the entrance 150, the head of the hook 233 is inserted in a lock assembly (not shown in the drawing) provided to the cabinet 100 to be fixed thereto.

The elastic member 234 is provided in the doorframe 210 to give an elastic force to the hook 233. Specifically, the elastic member includes a partially coiled spring. And, one end of the elastic member 234 is installed to push the hook 233 to one side.

A force is always applied in one direction to the above-constructed hook 233. Hence, having inserted in the lock assembly provided to the cabinet 100, the head adheres closely to one side of the lock assembly. In doing so, the protruding side of the head is caught on an inside of the lock assembly so that the door assembly 200 is unable to be unlocked by itself. Of course, if a user pulls the door assembly 200, the entrance 150 is opened.

Meanwhile, in case that a device catching the head to fix thereto is further provided to the lock assembly, the door assembly 200 closed the entrance is completely locked. Hence, even if the door assembly 200 is pulled, the entrance 150 is unable to be open. In such a case, if a user operates the control panel 130 to release the locking, the door assembly 200 can be pulled to open the entrance 150.

Meanwhile, stoppers 235 can be further provided to the hook assembly 230 according to the present invention. The stoppers 235 extend from insides of the doorframe 210 to prevent the shaft 232 from being separated from the supporters 231, respectively. The supporters 231 lie between the stoppers 235, and a distance between the stoppers 235 is equal to or a little bit greater than a length of the shaft 232. Once the stoppers 235 are provided, both ends of the shaft 232 are supported by the stoppers 235, respectively, whereby the shaft 232 is not separated from the supporters 231.

The stoppers 235, as shown in FIG. 6A and FIG. 6B, preferably extend from the inner frame 211 and the outer frame 212, respectively. Such a structure facilitates to insert the shaft 232 in the supporters 231. Namely, if both of the supporters 235 and the stoppers 231 extend from the inner frame 211, it is difficult to insert the shaft 232 in the supporters 231 because of the stoppers 235. Since the stoppers 235 are provided to the inner frame 211 and the outer frame 212, respectively. The shaft 232 can be easily inserted in the supporters 231. Meanwhile, the supporters 231 and the stoppers 235 can extend from the inner frame 211 and the outer frame 212, respectively.

Referring to FIG. 6A to FIG. 7, a reinforcement rib 235*a* is further provided to each of the stoppers 235. The reinforcement rib 235*a* extends from one side opposite to the side supporting the corresponding end of the shaft 232. If the reinforcement rib 235*a* is provided, it is able to effectively prevent the stopper 235 from being pushed or broken by the shaft 232.

Meanwhile, the hook assembly 230 according to the present invention may further include a grip 236. One end of the grip 236 is rotatably connected to the shaft 232, and the other end of the grip 236 passes through the doorframe 210 to be externally exposed. The grip 236 elastically turns the hook 233 when the user moves the other end of the grip 236. For this, one end of the elastic member 234 is connected to the hook 233, and the other end of the elastic member 234 is connected to the grip 236.

Thus, the grip 236 moves to compress or extend the elastic member 234, and the corresponding force is transferred to turn the hook 233. Hence, the user just grabs the grip 236 and pushes or pulls the door assembly to unlock the door assembly 200.

The door assembly 200 according to the present invention is assembled in the following manner.

First of all, the hook 233, elastic member 234, and grip 236 are aligned between the supporters 231 of the inner frame 211. The shaft 232 is then inserted in the supporters 231 to be fixed thereto. In doing so, the head of the hook 233 is disposed to penetrate the hole 211*b*, and the shaft 232 is inserted from a side where the stopper 235 is not provided.

Once the shaft 232 is fixed, the other end of the elastic member 234, as shown in FIG. 7, is coupled to the grip 236. One end of the elastic member 234, as shown in FIG. 6A, adheres closely to the hook 233.

After the elastic member 234, hook 233, grip 236, and shaft 232 are put together, the door glass is disposed between the inner and outer frames 211 and 212. And, the coupling members are inserted in the bosses 211*a* and 212*a*, respectively to fix the door glass thereto, whereby the door assembly 200 is completed. The completed door assembly 200 is hinge-coupled to the cabinet 100 to open/close the entrance 150.

An operation of the washing machine according to the present invention is explained as follows.

First of all, a laundry is put in the drum 320, the door assembly 200 is closed, and the control panel 130 is operated, in turn. After operation of the control panel 130, the water supply equipment 330 appropriately supplies water and detergent to the drum 320. While the drum 320 rotates, the laundry is lifted up by the tumbling ribs 322 to fall for washing.

After completion of the washing, the drain equipment 340 discharges the used water in the drum 320 and the tub 310 outside. After completion of draining, the water supply equipment 330 supplies water to the drum 320. The drum 320 then rotates to rinse the laundry. And, the drain equipment 340 discharges the rinsing water outside. Such a rinsing step is repeated at least once.

After completion of rinsing, the drum 320 rotates at high speed. The corresponding centrifugal force separates water contents from the laundry. After completion of dewatering, the user pulls out the washed and dewatered laundry through the entrance 150.

Besides, if a drying function is provided to the washing machine, hot air is blown to the drum 320 to completely dry the laundry.

Accordingly, the washing machine according to the present invention has the following advantages or effects.

First of all, the hook assembly is directly formed in the doorframe to reduce the number of elements constructing the door assembly. Therefore, the present invention simplifies an assembling process, thereby enhancing productivity and reducing costs.

Secondly, if the stoppers are further provided to the hook assembly, the shaft is prevented from being separated. Therefore, the present invention prevents failure of the hook assembly.

Thirdly, if the grip is further provided to the hook assembly, the user enables to open/close the door assembly conveniently using the grip.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A hook assembly for a door of a washing machine, comprising:

a pair of supporters configured to directly extend from an inside of a doorframe of a washing machine;

a shaft configured to penetrate the pair of supporters;

a hook configured to be rotatably coupled to the shaft and having a head configured to penetrate the doorframe to be externally exposed;

an elastic member configured to give an elastic force to the hook, wherein the doorframe comprises separable inner and outer frames, and wherein the pair of supporters extend from either the inner frame or the outer frame; and stoppers configured to extend from an inside of the doorframe and prevent the shaft from being separated from the pair of supporters.

2. The hook assembly as claimed in claim 1, wherein the pair of supporters lie between the stoppers.

3. The hook assembly as claimed in claim 2, wherein a distance between the stoppers is greater than the length of the shaft.

4. The hook assembly as claimed in claim 1, wherein the stoppers extend from the inner and outer frames, respectively.

5. The hook assembly as claimed in claim 1, wherein each of the stoppers comprises a reinforcement rib provided to one side opposite to the other side supporting a corresponding end of the shaft.

6. The hook assembly as claimed in claim 1, further comprising a grip having one end rotatably connected to the shaft and the other end externally exposed, wherein the one end elastically turns the hook if the other end moves.

7. The hook assembly as claimed in claim 6, wherein both ends of the elastic member are connected to the hook and the grip, respectively, so that the hook is moved together with the grip.

8. A washing machine, comprising:

a cabinet having an entrance at a front side;

a tub in the cabinet;

a drum rotatably provided in the tub; and a door assembly coupled to the cabinet to open/close the entrance, the door assembly comprising:

a doorframe hinge-coupled to the cabinet;

a pair of supporters configured to directly extend from an inside of the doorframe;

a shaft configured to penetrate the pair of supporters;

a hook configured to rotatably coupled to the shaft and having a head configured to penetrate the doorframe to be externally exposed;

an elastic member provided in the doorframe configured to give an elastic force to the hook, wherein the doorframe comprises separable inner and outer frames, and wherein the pair of supporters extend from either the inner frame or the outer frame; and stoppers configured to extend from an inside of the doorframe and prevent the shaft from being separated from the pair of supporters.

9. The washing machine as claimed in claim 8, wherein the pair of supporters lie between the stoppers.

10. The washing machine as claimed in claim 9, wherein a distance between the stoppers is greater than a length of the shaft.

11. The washing machine as claimed in claim 8, wherein the stoppers extend from the inner and outer frames, respectively.

12. The washing machine as claimed in claim 8, wherein each of the stoppers comprises a reinforcement rib provided to one side opposite to the outer side supporting a corresponding end of the shaft.

13. The washing machine as claimed in claim 8, further comprising a grip having one end rotatably connected to the shaft and the other end externally exposed, wherein the one end elastically turns the hook if the other end moves.

14. The washing machine as claimed in claim 13, wherein both ends of the elastic member are connected to the hook and the grip, respectively, so that the hook is moved together with the grip.

15. A washing machine, comprising:

a cabinet having an entrance at a front side;

a tub in the cabinet;

a drum rotatably provided in the tub; and a door assembly coupled to the cabinet to open/close the entrance, the door assembly comprising:

a doorframe hinge-coupled to the cabinet a pair of supporters configured to directly extend from an inside of a doorframe of a washing machine;

a shaft configured to penetrate the pair of supporters;

a hook configured to be rotatably coupled to the shaft and having a head configured to penetrate the doorframe to be externally exposed;

an elastic member configured to give an elastic force to the hook; and stoppers configured to extend from an inside of the doorframe and prevent the shaft from being separated from the pair of supporters.

16. The washing machine as claimed in claim 15, wherein the pair of supporters lie between the stoppers.

17. The washing machine as claimed in claim 16, wherein a distance between the stoppers is greater than a length of the shaft.

18. The washing machine as claimed in claim 15, wherein the doorframe comprises separable inner and outer frames and wherein the stoppers extend from the inner and outer frames, respectively.

19. The washing machine as claimed in claim 15, wherein each of the stoppers comprises a reinforcement rib provided to one side opposite to the outer side supporting a corresponding end of the shaft.

20. A washing machine, comprising:

a cabinet having an entrance at a front side;

a tub in the cabinet;

a drum rotatably provided in the tub; and a door assembly coupled to the cabinet to open/close the entrance, the door assembly comprising:

a doorframe hinge-coupled to the cabinet a pair of supporters configured to directly extend from an inside of a doorframe of a washing machine;

a shaft configured to penetrate the pair of supporters;

a hook configured to be rotatably coupled to the shaft and having a head configured to penetrate the doorframe to be externally exposed;

an elastic member configured to give an elastic force to the hook; and a grip having one end rotatably connected to the shaft and the other end externally exposed, wherein the one end elastically turns the hook if the other end moves.

21. The washing machine as claimed in claim 20, wherein both ends of the elastic member are connected to the hook and the grip, respectively, so that the hook is moved together with the grip.

* * * * *